United States Patent [19]

Löthman et al.

[11] 4,225,556

[45] Sep. 30, 1980

[54] METHOD AND APPARATUS FOR THE STERILIZING OF A PACKING MATERIAL WEB

[75] Inventors: Stig A. Löthman, Södra Sandby; Alfred Fuchs, Lund, both of Sweden

[73] Assignee: Tetra Pak International AB, Lund, Sweden

[21] Appl. No.: 839,274

[22] Filed: Oct. 4, 1977

[30] Foreign Application Priority Data

Oct. 7, 1976 [SE] Sweden ..... 7611124

[51] Int. Cl.[2] ..... A61L 1/00; A61L 3/00; B65B 55/10

[52] U.S. Cl. ..... 422/28; 53/167; 53/425; 422/292; 422/305

[58] Field of Search ..... 21/78, 92, 93, 91; 53/167, 425; 422/28, 29, 292, 305

[56] References Cited

U.S. PATENT DOCUMENTS

| | | | |
|---|---|---|---|
| 3,692,468 | 9/1972 | Loliger et al. | 21/92 |
| 3,854,874 | 12/1974 | Loliger et al. | 21/93 |
| 3,904,361 | 9/1975 | Egger | 21/57 |
| 3,911,642 | 10/1975 | Ernstsson et al. | 21/56 |
| 4,055,035 | 10/1977 | Sjöstrand et al. | 21/93 |
| 4,066,399 | 1/1978 | Gunther | 21/91 |

FOREIGN PATENT DOCUMENTS

| | | | |
|---|---|---|---|
| 1802778 | 6/1969 | Fed. Rep. of Germany | 21/78 |

*Primary Examiner*—Bradley R. Garris

*Attorney, Agent, or Firm*—Burns, Doane, Swecker & Mathis

[57] ABSTRACT

Sterilization of a web of packing material is accomplished in two steps with the web first being coated and washed with a sterilizing agent in liquid form at a first treatment station. The web then passes through a second treatment station where sterilizing liquid is sprayed as a fine mist onto a heated surface which vaporizes the sterilizing liquid. The vapor condenses on the passing web to further sterilize the web. One or more heaters again vaporizes the sterilizing agent which is on the packing web to remove the sterilizing agent. The sterilized packing material web is then cut into individual package units after the web has been filled with sterile contents.

11 Claims, 2 Drawing Figures

6
14
18
20
20
17
16
19
1
22
33
30
2
31
15
29
26
21
25
24
11
28
10
8
27
23
7
9
3
13
12
10
4
5

21
1
32
31
30

METHOD AND APPARATUS FOR THE STERILIZING OF A PACKING MATERIAL WEB

The present invention relates to an arrangement for the sterilizing of a packing material web which in a packing machine is transformed to individual package units filled with sterile contents, which arrangement comprises units for the application of a liquid sterilizing agent to at least one side of the web as well as units for removing the sterilizing agent again from the packing material web once the sterilizing effect has been achieved.

A frequently encountered consumer package of the one-way type for e.g. milk is manufactured from a web-shaped packing laminate comprising a carrier layer of fibrous material which is covered on either side with thin plastic layers. The manufacture takes place in a known machine in such a manner that during the passage through the packing machine the web is folded to tube-shape in that both of its longitudinal edges are made to overlap each other a little and are sealed to one another. This transforming of the packing material web takes place continuously during the advance of the material web mainly vertically downwards through the machine. After the transformation to tube-shape, the contents are fed to the tube continuously through a filler pipe which extends into the tube through its upper open end. During the further advance of the tube downwards, it is pressed flat and sealed by sealing jaws arranged on either side of the tube along narrow transverse zones situated at a distance from one another. The supply of contents is controlled automatically during the whole time in such a manner that the level of contents is well above the point where the pressing flat and sealing of the tube take place. After the sealing and possible shaping of the tube it is cut by transverse cuts in the sealing zones, whereupon the manufacture of the completely filled individual packing units is complete.

The abovedescribed packing machine is known and it is also known that sterile packages can be manufactured on such a packing machine. Here the filling takes place under aseptic conditions, which means that the atmosphere in the material tube as well as the material tube itself (or in any case its inside) have to be kept sterile. To achieve the former, a certain pressure of sterile air is maintained in the packing material tube, so that non-sterile air cannot penetrate in from the surrounding atmosphere. The sterilization of the packing material web takes place in a known realization of the machine described in that the packing material web, before formation to tube-shape, is made to run through a bath of chemical sterilizing agent, usually a solution of hydrogen peroxide, which is made to moisten the packing material, whereupon the excess liquid is stripped off the material web by means of mangle rollers. The portion of sterilizing agent which remains on the packing material web is removed after the formation of the web into a tube from the inside of the tube by means of a heating arrangement, usually a heating coil, a so-called tube heater, arranged around the filler pipe which heats the inside of the packing material tube and the residues of sterilizing agent remaining thereon to such an extent that the agent is evaporated and escapes from the upper open end of the packing material tube. To ensure an even application of sterilizing agent to the web, and hence an effective sterilization, the sterilizing agent has to contain a wetting agent which is a disadvantage, since the wetting agent cannot easily be fully removed and moreover implies an undesirable extra cost.

Another method for providing sterilization of packing material webs in the type of machine described is also known. In accordance with this method a liquid sterilizing agent, preferably a mixture of hydrogen peroxide and water, is introduced into a dishlike container present in the material tube. The container is situated around the filler pipe and is heated to such a temperature that the sterilizing agent when it is delivered dropwise to the dish evaporates immediately. The vapour rises upwards through the tube and is deposited at the upper end of the inside wall of the tube. During the continuous movement downwards of the tube the vapour, condensed at a certain moment at the upper end of the tube, will pass the tube heater of the type described earlier arranged in the tube which heats the inside wall of the tube as well as the sterilizing agent condensed on the same so vigorously that the agent is evaporated again and rises upwards to the region of the upper end of the tube where it is recondensed on the colder material wall. This process is repeated as long as the packing machine is in operation, and the whole time a dropwise delivery of sterilizing agent to the heated dish takes place, so as to replace the loss which arises through part of the evaporated sterilizing agent rising upwards through the upper end of the tube without being condensed on the tube wall.

The sterilizing agent usually employed consists of hydrogen peroxide and water. The concentration of pure sterilizing agent in the mixture is only between 10–35% and cannot be increased appreciably since the risk of explosions of hydrogen peroxide increases with rising concentration. When a drop of sterilizing agent mixture is delivered to the heated container the water portion will first escape in the form of steam, since the boiling point of hydrogen peroxide is appreciably higher than the boiling point of water. Only when the major part of the water in the drop has been evaporated, the hydrogen peroxide in turn will operate which means therefore that the concentration of hydrogen peroxide inside the tube varies considerably, at the same rate as the delivery of drops of sterilizing agent. This is a disadvantage which has been found to involve difficulties in the obtaining of a uniform sterilizing effect.

It is an object of the present invention to provide an arrangement of the type described in the beginning which ensures an effective sterilization without utilization of a wetting agent and without being subject to any of the disadvantages of the arrangements known hitherto.

These objects have been achieved in accordance with the invention through giving an arrangement of the type described in the introduction the characteristic that the unit for the supply of sterilizing agent comprises a first treatment station with a container for sterilizing liquid through which the packing material web is arranged to pass and with elements for the mechanical washing of the packing material web, and a second treatment station comprising a chamber provided with inlet and outlet openings for the web in which is arranged a nozzle element for sterilizing liquid which is directed towards a surface which is heatable to a temperature exceeding the temperature of evaporation of the sterilizing liquid used.

A preferred embodiment of the arrangement in accordance with the invention has been given moreover the characteristic that the heated surface is part of a heatable body and has a temperature of between 160°-250° C.

The arrangement in accordance with the invention is further characterized in that the nozzle element is a spray nozzle.

It is a further characteristic of the arrangement in accordance with the invention that a time and pressure controlled valve is arranged upstream of the nozzle element so as to regulate the supply of sterilizing agent.

The invention will be described further in the following with reference to the enclosed drawing.

Figures 1, 2:
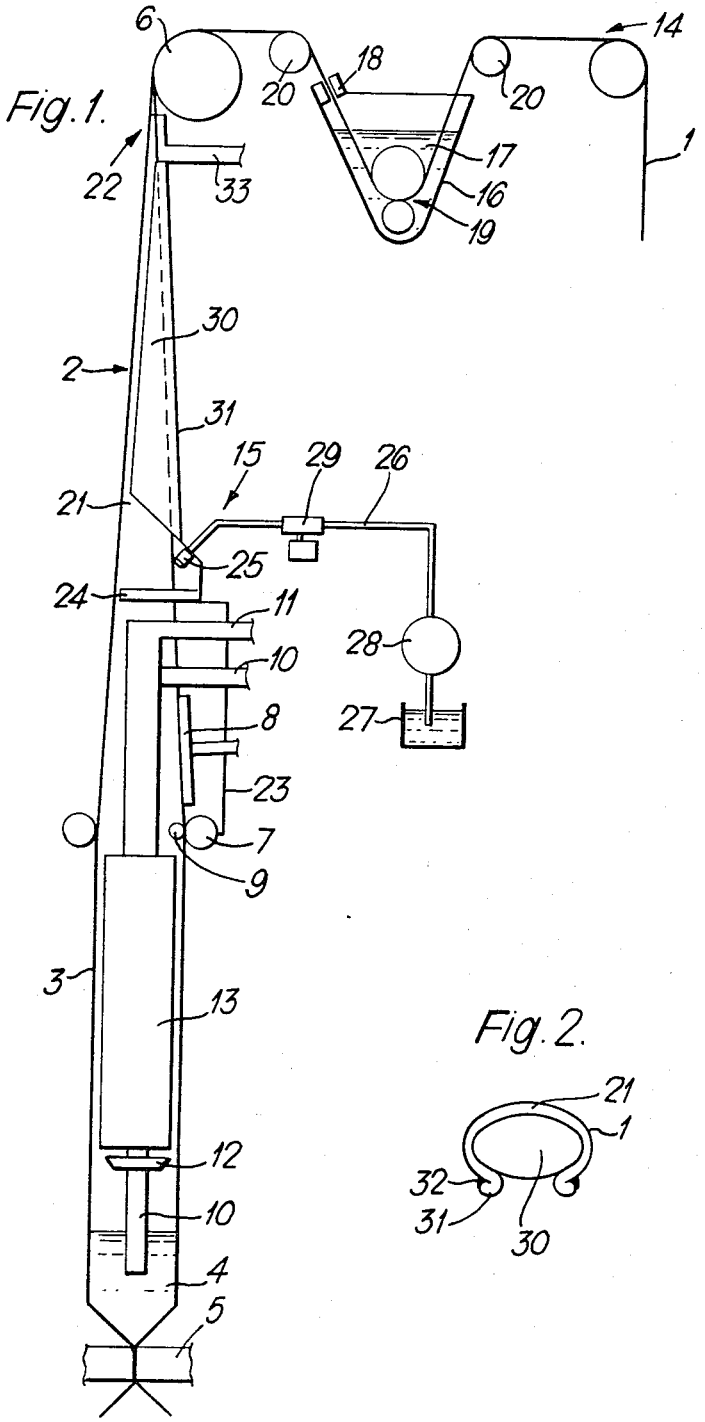
FIG. 1 shows schematically and partly in cross-sectional presentation a preferred embodiment of the arrangement in accordance with the invention on a packing machine of known type.
FIG. 2 is a section through a part of the arrangement in accordance with FIG. 1.

The packing machine shown in FIG. 1 manufactures individual liquid-filled packages from a continuous packing material web 1 passing through the machine. The packing material web 1 is folded by the machine in an area designated by reference numeral 2 to a tubular body 3, which, after filling with sterile contents 4, is transversely sealed by means of sealing jaws 5 and cut to individual packages, not shown on the drawing. The machine comprises a number of guide rollers and other guide elements for the packing material web which, however, are of the conventional type and in most cases are not shown on the drawing. During the transformation of the packing material web to tubular shape, the web is moved mainly vertically downwards from an upper pulley 6 to a forming element 7 which consists of a number of freely rotating rolls arranged in annular form. When the packing material web 1 has reached the forming element 7, the two longitudinal edges of the web overlap one another a little, and with the help of a heating element 8 arranged directly above the forming element 7 the thermoplastic layer of the two edges is heated, whereupon the edges are pressed together with the help of a compression element 9, so that a longitudinal seal is formed. Above the heating element 8 is located a pipe for the supply of sterile contents to the lower end of the tube 3 which is sealed so that it is impervious for liquids, where a float (not shown on the drawing) monitors the level of the contents and controls the delivery so that the level of contents is always above the level at which the transverse clamping together and sealing of the tube takes place by means of the jaws 5. The filler pipe 10 is surrounded for the greater part of its length with a supply pipe 11 for sterile air. The supply pipe 11 extends vertically downwards through the tube 3 and ends at some distance above the contents level in a so-called jet deflector 12, which deflects the air flowing from the annular lower end of the supply pipe 11 so that the same is blown upwards through the tube 3. Beside the two supply pipes 10 and 11 for the contents and the sterile air respectively a tube heater 13 is present in the material tube 3 which consists of an electrically heatable element located co-axially around the two supply pipes.

The packing machine described which in known in itself comprises in accordance with the invention elements for the sterilization of the packing material web, more precisely in the form of a first treatment station 14 and a second treatment station 15. The first treatment station 14 is situated at the upper end of the machine and comprises a container 16 for sterilizing liquid 17 and elements 18 for the wiping of the sterilizing agent from the web. In the lower part of the container a unit 19 is located comprising a guide roller around which the web is guided and a brush, sponge or the like arranged underneath the same which is rotatable and rests against the side of the web which subsequently will constitute the inside of the packing container. With the help of guide rollers 20 upstream and downstream of the container 16 the web is passed down into the bath of sterilizing agent 17 along the one wall of the container 16 and upwards out of the bath along the other wall of the container, the web 1 passing, as it emerges from the container, the wiping element 18 which may be constituted e.g. of rubber scrapers.

When the packing material web 1 has passed the roller 6 located at the upper end of the packing machine it comes into contact with the second treatment station 15 which comprises a treatment chamber 21 which extends vertically from an upper inlet end 22 arranged in the vicinity of the roller 6 to a lower outlet end arranged on the tube forming element 7. The lower half of the treatment chamber 21 has the form of a conventional casing 23 which on the tube-forming element 7 rests tightly against the outside of the material tube 3 and for the rest comprises the sealing element 8 as well as the supply pipes 10, 11 for contents and sterile air respectively. In the central part of the treatment chamber 21 is located a heatable body 24 in the form of a horizontally arranged plate, against the upper side of which is directed a nozzle element 25. The nozzle element 25 is fitted to the wall of the casing 23 and is connected to a line 26 extending outside the treatment chamber 21, whose end extend down into a container 27 for sterilizing liquid. The line is also provided with a pump 28 for sterilizing liquid and a time-controlled valve 29 for the regulation of the liquid flow to the nozzle 25. The upper part of the treatment chamber 21 comprises an elongated body 30, which can be heated, and which is provided with two longitudinal guide rails 31 which with the help of a packing element 32 are arranged to rest tightly against the two longitudinal edges of the material web 1. The treatment chamber 21 is thus shaped like a half moon (FIG. 2) and is limited by the heatable body 30, the two guide rails 31 and the side of the material web 1 turned towards the body 30. The section through the treatment chamber 21 shown in FIG. 2 is taken at a level a little above the nozzle element 25, at which level the formation of the material web 1 to tubular shape has gone relatively far. A corresponding section through the upper end of the treatment chamber 21 (that is to say directly below the end indicated by reference numeral 22) would show a material web 1 which has only been given a very slight curvature and a treatment chamber 21 of a corresponding shape. Finally there is an outlet pipe 33 at the upper end of the treatment chamber 21 for the sterile air mixture flowing upwards through the tube 3 and treatment chamber 21 which will be described in detail in the following.

As can be seen from the drawing, the one wall of the treatment chamber 21 (on the lefthand side on the drawing) consists permanently of the packing material web itself, whilst the other wall portion of the treatment chamber 21 consists in the upper part of the treatment chamber of the heatable body 30 and in the lower part of the treatment chamber of the casing 23. Between the packing material web and the body 30 and casing 33 respectively are the aforementioned guide rails 31 which guide the packing material web 1 on its path downwards towards the forming ring 7 and at the same time ensure with the help of packing 32 a good seal against the edge region of the material web 1. The guide rails 31 also contribute to the transformation of the packing material web on its way from the roller 6, where the cross-section of the web is plane, to the forming ring 7, where the web has a circular cross-section.

The packing material web 1 consists of laminated material and comprises layers of paper, aluminum foil and thermoplastic material. During operation the web is fed to the upper end of the machine via a number of guide rollers and pulleys to enter the container 16 with sterilizing liquid 17. The container 16 is of mainly triangular cross-section and the packing material web 1 passes over a pulley 20 down along one sidewall of the container through the washing unit 19, arranged at the base of the container 16, and up along the opposite wall of the container to pass through the element 18 for the mechanical wiping off of the sterilizing agent before the web is guided again via a further guide roller 20 to the guide wheel 6 arranged at the upper end of the packing machine. The unit 19 comprises fixed or movable sponges, scrapers, brushes or the like which wash at least one side of the web which will later constitute the inside of the packing container. This first treatment serves not only for bringing the web into contact with the sterilizing liquid, but also, through the mechanical cleansing, washes out or a least detaches and disperses the bacteria which are present on the web, and in this manner prepares the web for the subsequent treatment with sterilizing agent.

After the preparatory treatment described, the main treatment of the packing material web 1 takes place at the second treatment station 15, that is to say in the treatment chamber 21 at the upper end 22 of which the packing material web is introduced directly after it has passed the guide roller 6. From the guide roller 6 the web is guided in plane condition between the guide rails 21 arranged on the heatable body 30. During the successive movement downwards through the packing machine, the web is now transformed to tubular shape with the help of the guide rails and the forming element. During the whole time the edges of the packing material web 1 rest tightly against the packings 32 of the guide rails 31 and with the help of the web 1, the heatable body 30 and the casing 23 the closed treatment chamber 21 is thus formed against which the side of the packing material web, which is to form the inside of the packing container is exposed during the whole distance from the inlet opening 22 until the material has been transformed to individual packages. Into the treatment chamber 21 is blown, as mentioned earlier, continuously a stream of sterile air via the pipe 11. The air escapes at the lower end of the material tube 3 and is deflected by means of the jet deflector 12 so that it flows upwards between the tube heater 13 and the inner wall of the material tube 3 and further upwards through the chamber 21 past the nozzle 25 and out through the outlet pipe 33 at the upper end of the chamber. Sterile air is blown in the whole time to such an extent that a certain pressure is obtained inside the tube, which ensures a good seal between the packings 32 and the edge region of the packing material 1 and ensures moreover that the surrounding air cannot penetrate in through possible small leaks in the treatment chamber 21.

During operation sterilizing agent, usually hydrogen peroxide, is fed to the nozzle 25. The peroxide is pumped by means of the pump 28 from the container 27 and with the help of the time-controlled valve 29 a certain quantity of hydrogen peroxide is injected at certain intervals into the treatment chamber 21. The nozzle 25 through which the hydrogen peroxide is injected is a spray nozzle and thus atomizes the peroxide injected to a very high degree so that it meets in the form of a mist or very small droplets the heatable body 24 arranged in front of the nozzle 25, whose surface facing the nozzle has a temperature of 160°–250° C. This temperature is regulated as a function, in the first place of the temperature of evaporation of the sterilizing agent used, in the second place of the quantity of sterilizing agent supplied, and in the third place of the mass of the heatable body, in such a manner that the sterilizing agent supplied (e.g. hydrogen peroxide) at no time can cool down the surface of the body to a temperature below the temperature of evaporation of the sterilizing agent. This means that every small droplet of hydrogen peroxide when it makes contact with the surface is immediately evaporated, that is to say the proportion of pure peroxide in each droplet is evaporated at the same time as the proportion of water, which means that a homogeneous mist or vapour of hydrogen peroxide and water is produced. With the help of the sterile air injected down into the tube-shaped material 3 the vapour formed is now guided gently upwards into the treatment chamber 21 between the inside of the material web 1 and the oblong body 30 which is heated to a temperature high enough for the vapour not to condense on the same. The packing material web, on the other hand, is largely at room temperature which means that the vapour condenses in a uniform layer on the surface of the material web facing the treatment chamber 21, which in fact has been exposed previously already in the first treatment station 14 to a washing out and a first treatment with sterilizing agent. Through the washing out a large part of the bacteria has been removed, and the remainder of the bacteria layer has, so to speak, been evened out or spread, as a result of which each separate bacteria can more easily be reached by peroxide vapour which of course not only condenses on the paper but also on the bacteria themselves. This allows a very good bactericidal effect to be achieved. The excess or unused part of the peroxide vapour is passed together with the sterile hot air further upwards and out through the pipe 33, from where it can be conducted e.g. to a condenser for cooling and recovery of the peroxide. When the material web 1 has passed the upper part of the treatment chamber 21, no further peroxide vapour is supplied to it, but the inside of the material web now only comes into contact with the sterile air which is introduced via the pipe 11. This air, which is in fact heated when it passes upwards past the tube heater 13, causes a certain part of the condensed hydrogen peroxide to escape, and when the actual section of the material web has passed the form ring 7 and reaches the level of tube heater 13, the material web is heated to such an extent that the remaining part of the hydrogen peroxide condensed on the inside of the paper is heated and dried and accompanies the sterile air upwards through the material tube. The part of the material which has passed the tube heater is now sterilized and may be filled with sterile contents 4 via the supply pipe 10. Since the stream of sterile air blown in through the pipe 11 flows upwards continuously through the material tube 3 past the tube heater 13, it is assured that no bacteria can be entrained with the air down to the space below the tube heater 13, so that the sterility remains high.

Thanks to the combined arrangement in accordance with the invention, comprising a first treatment station which mechanically cleans and dries the web and a second treatment station in which the sterilizing agent is made to condense on the web, a bactericidal effect is achieved which exceeds the bactericidal effect obtained when similar arrangements were used separately. This can be explained by the effect mentioned earlier, whereby as a result of the first immersion in sterilizing agent and subsequent mechanical wiping, the bacteria, so to speak, are thinned out in a uniform layer over the whole web, which appreciably enhances the effect of the subsequent vapour of sterilizing agent.

It has been found that a nozzle 25 which atomizes the liquid as highly as possible gives the best effect which, as explained earlier, is due to the fact that the difference between the vapour which is produced at the beginning of the varpourization and that at the end of the vapourization will be the more noticeable the greater is the size of each individual droplet of sterilizing agent. In the case of large drops, that is to say drops in the true sense of the word, a concentration of sterilizing agent in the earliest stage of evaporation of 5% has been measured whilst at the end of the evaporation as good as pure sterilizing agent was vaporized. This gives rise to undesirable variations where the content of sterilizing agent in the vapour is concerned, and makes more difficult any regulation of the delivery of sterilizing agent and the sterilizing effect.

Since only the vapour is used, droplet formation is avoided, which means that the risk of explosions which exists when e.g. hydrogen peroxide is used as a sterilizing agent is diminished. The upper part of the treatment chamber 21 is filled all the time with vapour and the delivery of sterilizing agent via the nozzle 25 takes place at intervals which are regulated with the help of the time-controlled nozzle which is set as a function, above all, of the rate of movement of the material web.

Since all the sterilizing agent is applied at the upper end of the machine, the distance between the application station and the level of contents will be great which means that the drying and removal of sterilizing agent can be carried out very effectively, so that the risk of any entrainment of sterilizing agent into the contents is eliminated.

A further advantage of the arrangement in accordance with the invention is finally that the wetting agent, which previously had to be mixed into the sterilizing agent in order to obtain a uniform film of sterilizing agent on the web, is no longer required, either in the first treatment station 14 where the main purpose consists in fact in the mechanical wiping of the web or in the second treatment station 15, where the application of sterilizing agent in any case will be uniform, since it takes place by condensation.

The sterilizing arrangement in accordance with the invention can of course also be used on packing machines of a type different from that described above. Thus it is possible to use the sterilizing arrangement on the type of packing machines which operate with individual packing material blanks if these are attached to some form of transport belt in their passage through the sterilizing arrangement.

The presently disclosed embodiment of the invention is intended to be considered in all respects as illustrative and not as restrictive, the scope of the invention being indicated by the appended claims rather than by the foregoing description and all changes which come within the meaning and range of equivalency of the claims are therefore intended to be embraced therein.

We claim:

1. An arrangement for sterilizing a packing material web which is transformed in a packing machine into individual package units filled with sterile contents, comprising:

chamber means for conducting the packing material web, the chamber means having an inlet opening and an outlet opening;

heated surface means for providing a surface which is heatable to a temperature of at least the temperature of evaporation of a sterilizing agent, the heated surface means being arranged substantially within the chamber means; and, spray means for spraying the sterilizing agent as a mist to the heated surface means whereby the sterilizing agent is vaporized.

2. The arrangement of claim 1 further comprising:

web washing means for conducting the packing material web through a supply of liquid sterilizing agent, the web washing means being arranged upstream of the chamber means.

3. The arrangement of claim 1 further comprising:

means for heating the heated surface means to a temperature of between 160° C. to 250° C. at atmospheric pressure.

4. The arrangement of claim 1 wherein the spray means includes a nozzle element and a source of pressurized sterilizing agent, the pressurized sterilizing agent being supplied to and passing through the nozzle element whereby the sterilizing agent is transformed into the mist.

5. The arrangement of claim 4 further comprising:

time-controlled valve means for regulating the supply of the pressurized sterilizing agent to the nozzle element.

6. An arrangement for sterilizing a packing material web which is transformed in a packing machine into individual package units filled with sterile contents, comprising:

means for applying a sterilizing agent to at least one side of the web at first and second treatment stations, the first treatment station including a container through which the packing material web is arranged to pass, the container being provided with a supply of the sterilizing agent to mechanically wash the web;

the second treatment station including chamber means for conducting the packing material web, the chamber means having an inlet opening and an outlet opening, heated surface means for providing a surface which is heatable to a temperature of at least the temperature of evaporation of a sterilizing agent, the heated surface means being arranged substantially within the chamber means, and spray means for spraying the sterilizing agent as a mist to the heated surface means whereby the sterilizing agent is vaporized; and, means for removing the sterilizing agent from the packing material web after sterilization has occurred.

7. A method of sterilizing a packing material web which is transformed in a packing machine into individual package units filled with sterile contents, comprising the steps of:

conducting a packing material web through a chamber having an inlet opening and an outlet opening;

heating a surface which is arranged substantially within the chamber receiving the web to a temperature sufficient to vaporize a sterilizing agent;

spraying the sterilizing agent as a mist onto the heated surface;

vaporizing the sterilizing agent on the heated surface; and, condensing the vaporized sterilizing agent on at least one side of the web.

8. The method of claim 7 further comprising the steps of:

initially conducting the web through a container filled with liquid sterilizing agent; and, washing the web in the container with the sterilizing agent.

9. The method of claim 7 further comprising the step of:

removing the condensed sterilizing agent from the at least one side of the web.

10. The method of claim 7 wherein the heated surface is heated to a temperature between 160° C. and 250° C.

11. The method of claim 7 further comprising the step of:

regulating the spraying of the sterilizing agent to the heated surface as a function of time.

* * * * *